US005145426A

United States Patent [19]

Kobayashi et al.

[11] Patent Number: 5,145,426

[45] Date of Patent: Sep. 8, 1992

[54] MULTI JET PROPELLED WATERCRAFT

[75] Inventors: Noboru Kobayashi; Hirofumi Imaeda, both of Iwata, Japan

[73] Assignee: Yamaha Hatsudoki Kabushiki Kaisha, Shizuoka, Japan

[21] Appl. No.: 722,119

[22] Filed: Jun. 27, 1991

[30] Foreign Application Priority Data

Jul. 6, 1990 [JP] Japan ..... 2-180339

[51] Int. Cl.[5] ..... B63H 11/00; B63H 11/107; B63H 25/46; B63H 25/00

[52] U.S. Cl. ..... 440/38; 440/40; 440/42; 440/39; 114/151; 114/144 R; 114/150

[58] Field of Search ..... 440/38, 39, 40, 42, 440/43, 44, 39, 38; 114/151, 144 R, 150, 128, 23

[56] References Cited

U.S. PATENT DOCUMENTS 4,265,192 5/1981 Dunn ..... 440/40
4,392,443 7/1983 De Marco ..... 440/40
4,767,364 8/1988 Lenz ..... 440/38
4,779,553 10/1988 Wildhaber, Sr. ..... 440/38
4,953,492 9/1990 Duffy ..... 440/38

*Primary Examiner*—Joseph F. Peters, Jr.
*Assistant Examiner*—Kenneth Lee
*Attorney, Agent, or Firm*—Ernest A. Beutler

[57] ABSTRACT

A V bottom hull watercraft powered by a pair of jet propulsion units that are supported for pivotal movement about horizontally disposed pivot axes and rotary movement about a longitudinal pivot axis to rotate the water inlet openings and elevate them from a downwardly facing normal operating position and an upwardly facing service position. The water inlet openings are disposed so that they extend parallel to the sides of the V bottom. Steering nozzles are supported for pivotal movement at the discharge ends of the jet propulsion units and pivot about vertically extending axes that are not perpendicular to the water inlet openings so that no vertical thrust will be exerted on the watercraft hull when the steering nozzles are pivoted to effect steering.

27 Claims, 6 Drawing Sheets

MULTI JET PROPELLED WATERCRAFT

BACKGROUND OF THE INVENTION

This invention relates to a multi jet propelled watercraft and more particularly an improved jet propulsion unit for utilization in such a watercraft.

The copending application of Noboru Kobayashi, entitled "Watercraft With A Couple Of Water Jet Propulsion Units", Ser. No. 544,404, filed June 27, 1990, discloses a number of embodiments of watercraft having V hulls and in which a pair of jet propulsion units are employed for powering the watercraft. That type of watercraft has a great degree of utility. However, there are certain features in connection with such type of watercraft which can be improved upon. These features may be best understood by reference to FIG. 1 which is a cross sectional view taken through the tunnel portion of a watercraft having a V hull and a pair of jet propulsion units for operating the watercraft. As may be seen, the watercraft has a hull that is shown partially and is indicated generally by the reference numeral 11, which has a V bottom defined by a pair of angularly disposed lower surfaces 12 and 13. A tunnel 14 is provided in this hull at the rear end thereof and supports a pair of jet propulsion units 15 in side by side relationship.

As is noted in the copending application, there are a number of advantages in mounting the jet propulsion units 15 so that they can be raised and lowered to raise and lower the water inlet openings 16 of the jet propulsion units out of the body of water in which the watercraft is operating. In some instances, it is also desireable to rotate the water inlet portions 16 from their downwardly facing positions to an upwardly facing position so that the water inlet opening can be accessed for servicing through the hull of the watercraft by an access opening which is not shown in FIG. 1.

The raising and lowering of the jet propulsion units 15 is accomplished by pairs of hydraulic cylinders 17 which are connected to the jet propulsion units 15 in the manner described in the aforenoted application.

In the noted copending application, there a number of variations in tunnel arrangements disclosed. It will be noted that all of these tunnel arrangements require the jet propulsion units 15 to be spaced apart at a fairly substantial distance. The reason for this is to insure clearance between the jet propulsion units when they are raised to their elevated positions, as shown in phantom in FIG. 1. FIG. 1 clearly shows how interference can be encountered when the tunnel 14 is kept narrow, as is obviously desirable.

In addition, each jet propulsion unit 15 has a steering nozzle 18 which is supported for steering movement about a steering axis that is defined by a pair of pivot pins 19 which pivotally connect the steering nozzle 18 to the discharge nozzle of the jet propulsion unit 15. As may be readily seen, the jet propulsion units 15 are normally designed to operate so that the steering axes 19 are vertically disposed. However, when two such units are mounted in a V bottom hull and the water inlet opening 16 extends parallel to the hull surfaces 12 and 13, then the pivot axes of the steering nozzles become skewed and perpendicular to the surfaces 12 and 13, respectively.

As may be seen by the phantom line view of FIG. 1 wherein the nozzles are depicted toward a right hand steering position, the angular disposition of the pivot axes will give rise to not only steering thrusts, but thrusts that act in a vertical direction. Because of the opposite angular disposition, these vertical thrusts will be in opposite directions and tend to cause the generation of a turning moment on the watercraft 11, which is obviously undesirable.

It is, therefore, a principal object of this invention to provide an improved twin jet propulsion unit for a watercraft and particularly one having a V hull.

It is a further object of this invention to provide a twin jet propulsion unit for a watercraft having a V hull and in which a compact tunnel may be employed to contain both jet propulsion units.

It is a further object of this invention to provide a twin jet propulsion unit for a V hull watercraft that permits the jet propulsion units to be easily lifted relative to the body of water in which the watercraft is operating without interference.

It is a further object of this invention to provide an improved twin jet propulsion drive for a V bottom watercraft wherein steering can be accomplished without generating lifting or turning forces on the hull.

SUMMARY OF THE INVENTION

A first feature of the invention is adapted to be embodied in a jet propelled watercraft that is comprised of a V bottom hull with tunnel means disposed at the rear end thereof. A pair of jet propulsion units are each mounted in the tunnel means in side by side relationship. The jet propulsion units each have generally downwardly facing inlet openings that extend in a plane generally parallel to the respective side of the V bottom. Means are provided for pivotally supporting each of the jet propulsion units for pivotal movement about generally horizontally disposed axes for raising the water inlet openings relative to the body of water in which the watercraft is operating.

Another feature of the invention is also adapted to be embodied in a jet propelled watercraft having a V bottom hull with tunnel means disposed at the rear end thereof. A pair of jet propulsion units are each mounted in the tunnel means in side by side relationship and each has a generally downwardly facing water inlet opening extending in a plane generally parallel to the respective side of the V bottom of the hull. Each jet propulsion unit has a discharge nozzle with a pivotally supported steering nozzle juxtaposed thereto that receives water from the discharge nozzle and directs it rearwardly for propelling and steering the watercraft. In accordance with this feature of the invention, the steering nozzles are supported for steering movement about generally vertically extending steering axes so that steering movement will not generate vertical thrusts on the hull.

DETAILED DESCRIPTION OF THE PREFERRED EMBODIMENT OF THE INVENTION

Figure 1:
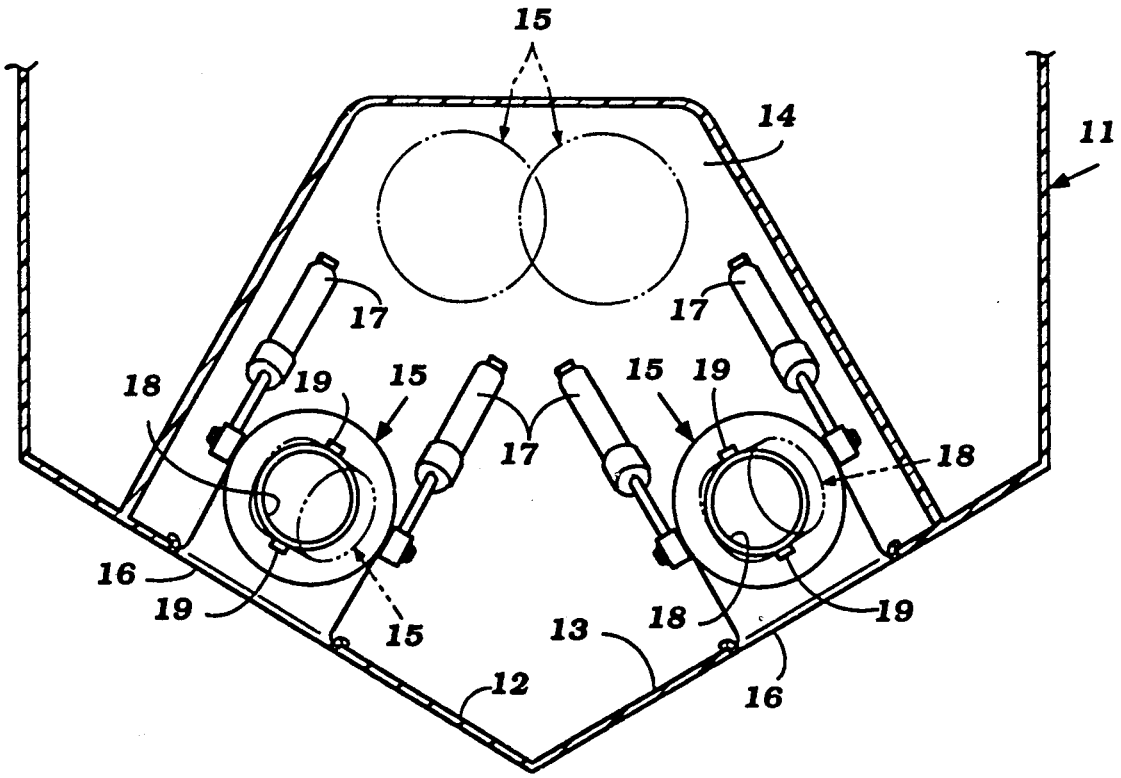
Figure 1 Prior Art
FIG. 1 is a cross sectional view taken through a hull of a V bottom twin jet propelled watercraft constructed in accordance with a prior art type of construction.

Referring now in detail to FIGS. 2 through 8, a watercraft constructed in accordance with an embodiment of the invention is identified generally by the reference numeral 11. The watercraft has been designated by the same reference numeral as the watercraft of the prior art construction because, except for differences which will be hereinafter noted, the construction of the watercraft per se is the same as the prior art. For that reason, those portions of the hull of the watercraft already enumerated have been identified by the same reference numerals including the tunnel 14 which is positioned at the rear of the watercraft on the V bottom sides 12 and 13. In accordance with the invention, however, the tunnel 14 can be made considerably narrower than the prior art constructions, although its size has been exaggerated in the drawings so as to more clearly show the construction. The reasons for this will become apparent.

Figure 2:
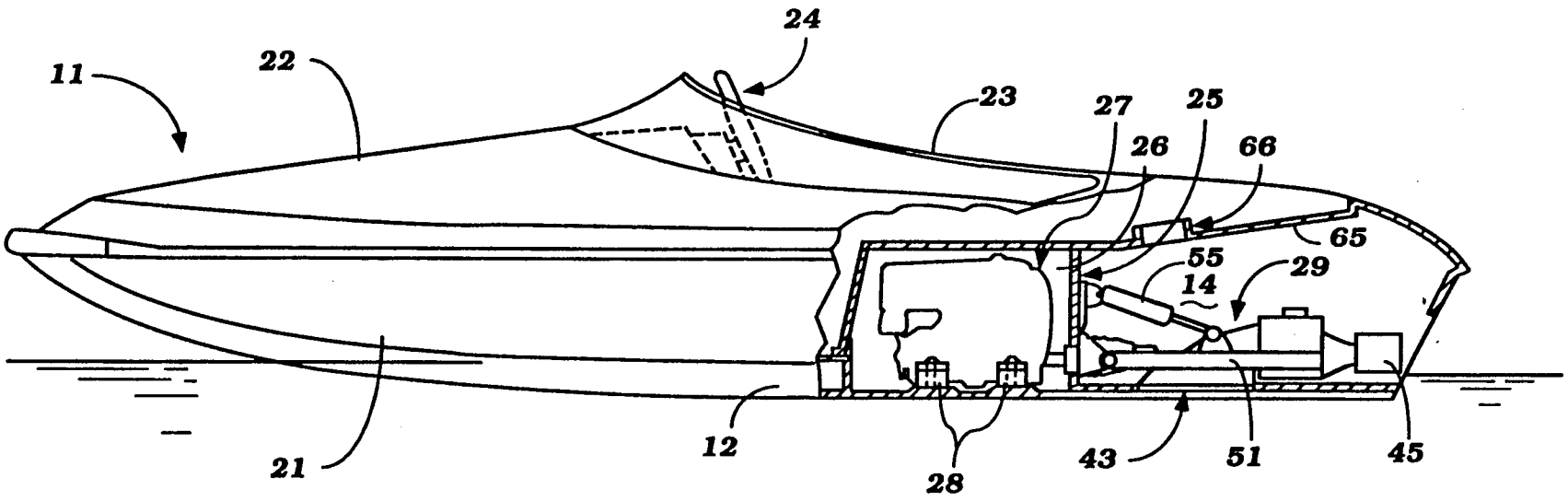
FIG. 2 is a side elevational view, with a portion broken away, of a watercraft constructed in accordance with an embodiment of the invention.

Referring primarily to FIG. 2 and for orientation purposes only, the watercraft 11 has a hull, aforenoted, which includes the V bottoms 12 and 13 which are formed by a lower hull portion 21. A deck 22 is affixed to the lower hull portion and defines a cockpit 23 that is designed to accommodate a plurality of riders. A steering wheel 24 and other controls are positioned at the forward end of the cockpit 23 on one side thereof for conventional control of the watercraft.

Figure 6:
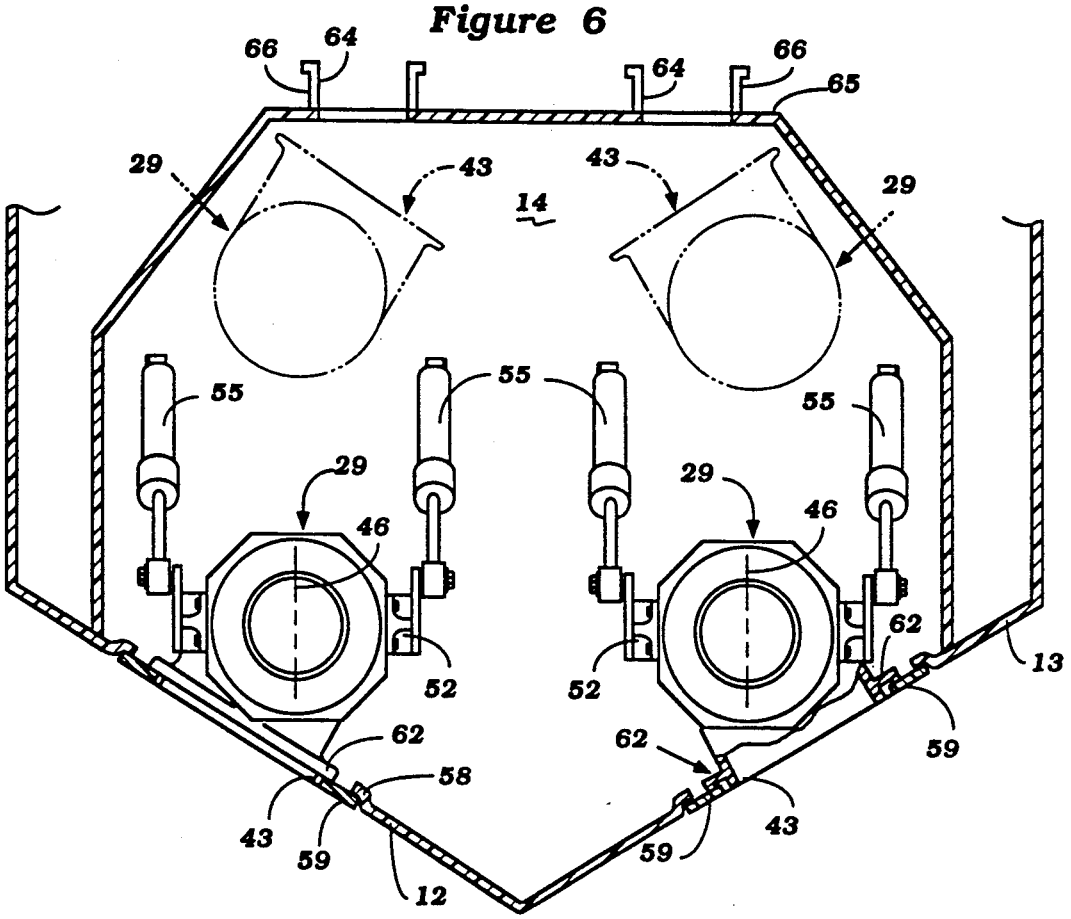
FIG. 6 is a cross sectional view, in part similar to the prior art construction of FIG. 1, but showing this embodiment of the invention.

The tunnel 14 has a forwardly disposed vertically extending bulkhead 25 forward of which is formed an engine compartment 26. The engine compartment 26 includes a pair of internal combustion engines 27 which are mounted on engine mounts 28 and each of drives a respective jet propulsion unit, indicated generally by the reference numeral 29 and each constructed in accordance with an embodiment of the invention. The jet propulsion units 29 are mounted in side by side relationship in the tunnel 14 in an orientation as best shown in FIG. 6 and which, because of the mounting and the manner in which they are moved, will avoid the problems attendant with the prior art type of construction.

Referring now in detail primarily to FIGS. 3 through 5, the construction of each jet propulsion unit 29 will be described. It should be understood that the jet propulsion units 29 each, except for the orientation of their steering nozzles and water inlet portions, as will be described, are the same as those shown in the copending application of Noboru Kobayashi, entitled "Water Jet Propulsion Boat", Ser. No. 680,709, filed Apr. 4, 1991. Because the construction of the jet propulsion units is substantially the same as in that application, a detailed description of their internal components will not be made in this application. Rather, the disclosure of that application is incorporated herein by reference.

Basically, each jet propulsion unit is comprised of a mounting bracket 31 which is affixed in a suitable manner on the rear of the bulkhead 25 and which has a bearing portion 32 which carries bearings 33 that rotatably journal an input shaft 34 that is driven by the output shaft of the engine 27 in an appropriate manner.

A universal joint assembly 35 interconnects the output shaft 34 with an impeller shaft 36 that is journaled within a housing assembly 37 of the respective jet propulsion unit 29. This housing 37 has a forwardly extending pilot portion 38 which carries a bearing 39 that journals the forward end of the impeller shaft 36. An impeller 41 is affixed to the impeller shaft 36 and, when rotated, will move water through the jet propulsion unit 29.

The housing assembly 37 defines a water inlet passage 42 which terminates in a generally downwardly facing water inlet opening 43 which extends parallel to the respective hull lower surface 13 or 14 as may be best seen in FIG. 6. As a result, the water inlet drawn into the passage 41 will flow in a perpendicular relationship to the hull surfaces 12 and 13.

The water which has been drawn through the water inlet opening 43 through the passageway 42 by the impeller 41 is discharged through a convergent discharge nozzle section 44 formed rearwardly in the housing portion 37 of the jet propulsion unit 29. A steering nozzle 45 is pivotally supported at the rear end of the discharge nozzle 44 for steering movement about a vertically extending steering axis by means of pivot pins 46. As may be seen best in FIG. 6, the pivot axis, defined by the pivot pins 46, shown by the broken line identified by this same reference numeral, extends in a vertical direction and hence is not perpendicular to the water inlet openings 43 as with prior art type of constructions. As a result of this, when the steering nozzles 45 are pivoted for their steering movement, there will be no vertical thrusts imparted to the hull of the watercraft. Hence, there will be no likelihood of tending to rotate the watercraft or cause it to list to one side or the other.

The universal joint 35 is surrounded by means of a protective boot 47 so as to protect the joint 35 from any corrosion or foreign materials. The universal joint 35 is disposed coincident with a pivot axis 48 that is defined for the jet propulsion unit 29 by means of a pair of outwardly extending arms 49 of the mounting portion 31. A pair of support arms 51 are pivotally connected to the pivot pins 48 and extend rearwardly to where there are fixed rigidly to a support ring 52. The support ring 52, as described in copending application Ser. No. 680,709, the disclosure of which has been incorporated herein by reference, rotatably journals the portion of the housing 37 of the jet propulsion unit 29 that defines the water inlet opening 43. However, the discharge nozzle 44 is fixed against rotation relative to the support ring 52, for a reason which will be described.

The support arms 51 have upwardly extending embossments 53 that are pivotally connected, by means of pivot pins 54 to the piston rods of hydraulic motors 55. The opposite ends of the hydraulic motors 55 and specifically their cylinder assemblies are pivotally connected by means of pivot pins 56 to further bosses 57 of the supporting bracket 31. Expansion and contraction of the hydraulic motors 51 will pivot the jet propulsion unit 29 as a unit about the pivot axis 48, which is disposed in a horizontal plane as best seen in FIG. 6, so as to raise and lower the jet propulsion units 29. The hydraulic motors 55 may be powered and actuated by any suitable mechanism Referring now in detail to FIGS. 6 and 8, the sealing arrangement between the water inlet openings 43 of the jet propulsion units 29 and the adjacent hull portions 12 and 13 will be described. It will be noted that the hull surfaces, as shown best in FIG. 8, have a flange portion 58 to which a sealing plate 59 is affixed by threaded fasteners 61. The water inlet housing portion of the jet propulsion unit housing 37 is provided with a flange 62 that encircles the inlet opening 43. A seal 63 is contained within this flange 62 and is adapted to sealingly engage the sealing plate 59 when the jet propulsion units 29 are in their operative positions as shown in the figures. When the fluid motors 56 are actuated, however, the seal 63 will move away from the sealing plate 59.

In addition to being pivotal about a horizontally extending axis defined by the pivot pins 48, at least the water inlet portion 43 of the jet propulsion unit 29 is rotatable so as to rotate the water inlet opening 43 from its downwardly facing position to an upwardly facing position for service through service openings 64 formed in a floor 65 of the hull of the watercraft which defines the tunnel 14. A flange like member 66 surrounds and defines the opening 64 and may carry a removable closure plate (not shown) so as to access the water inlet openings 43.

Figure 3:
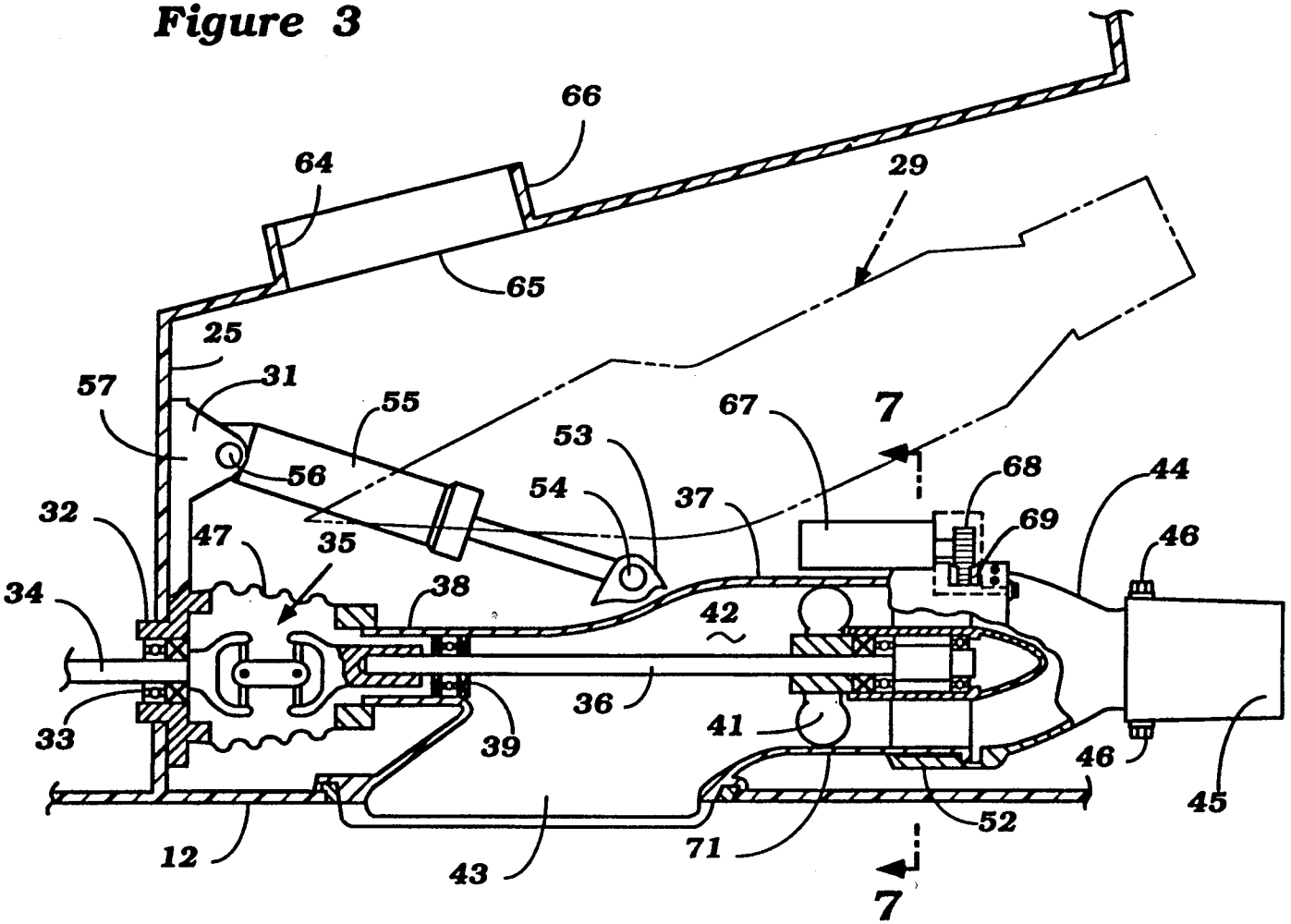
FIG. 3 is an enlarged cross sectional view taken through one of the jet propulsion units of the watercraft.
Figure 4:
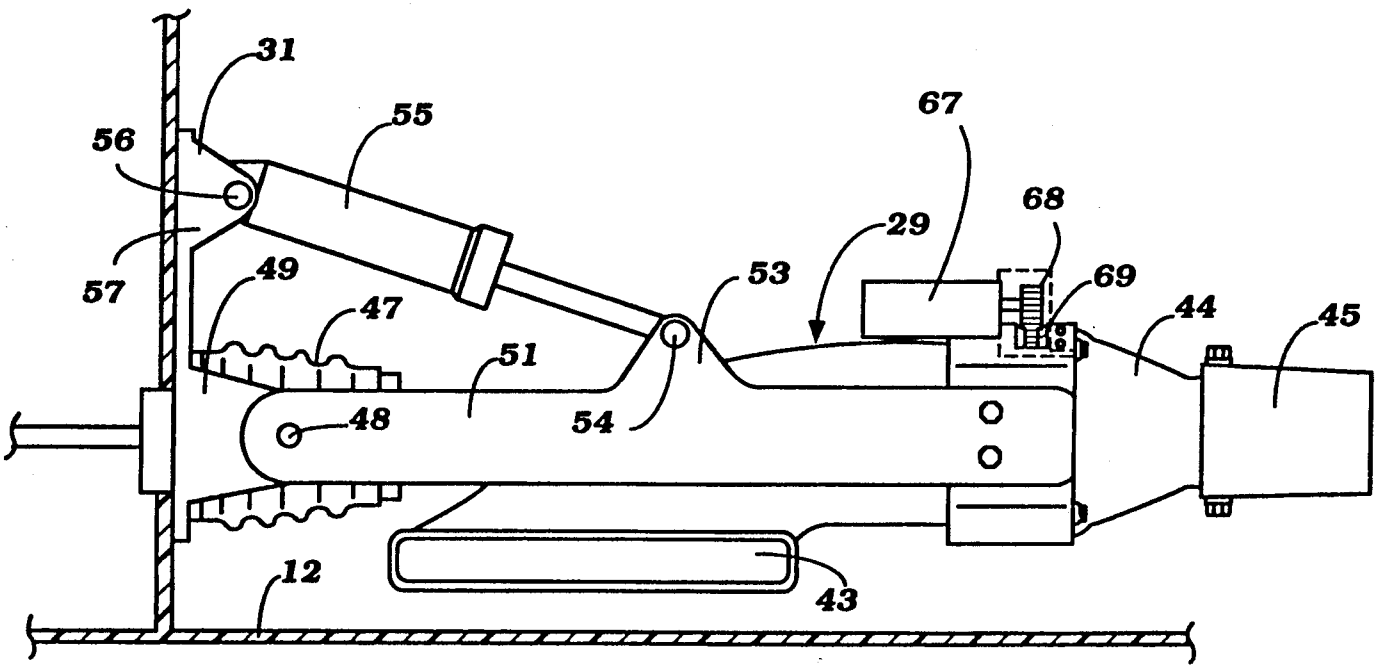
FIG. 4 is a side elevational view of the one jet propulsion unit shown in its normal operating condition.
Figure 5:
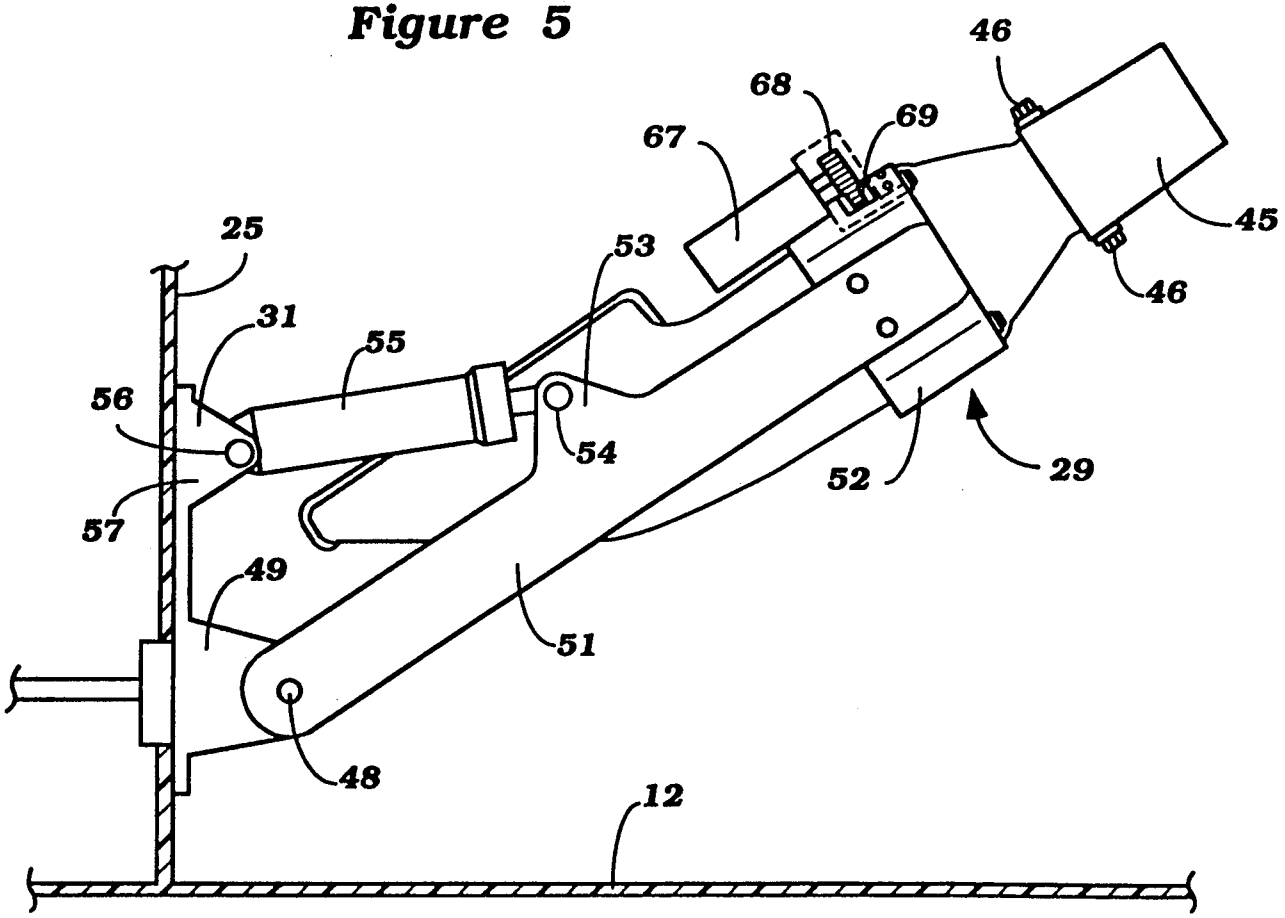
FIG. 5 is a side elevational view, in part similar to FIG. 4, and shows the jet propulsion unit raised and rotated to a service, out of the water position.

As may be best seen in FIGS. 3 through 5, an electric or hydraulic motor 67 is mounted on the support ring 52 and drives a pinion gear 68 that is enmeshed with a ring gear 69 that is fixed in a suitable manner or formed integrally with a housing portion 71 of the jet propulsion unit and specifically the impeller housing portion.

Figure 7:
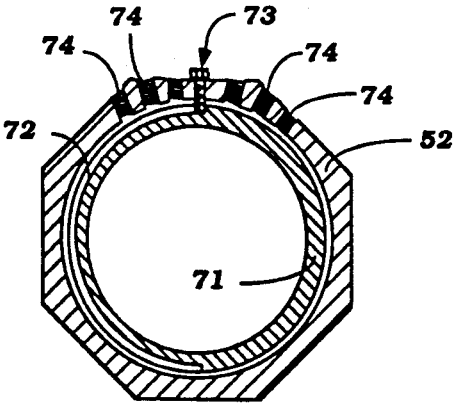
FIG. 7 is a cross sectional view taken along the line 7—7 of FIG. 3.
Figure 8:
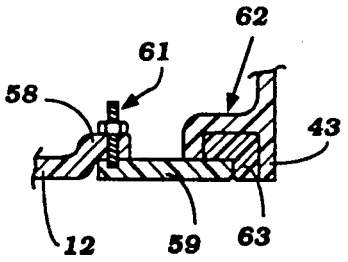
FIG. 8 is an enlarged cross sectional view showing the seal arrangement between the jet propulsion unit water inlet and the hull.

As may best be seen in FIG. 7, the housing portion 71 is formed with a circumferential slot 72 in which an adjusting stop pin 73 is received. The stop pin 73 is threaded into one of a plurality of circumferentially spaced tapped holes 74 formed around the periphery of the support ring 52. As may be best seen in FIG. 7, the contact of the stop pin 73 with the ends of the slots 72 will set the angular position of the water inlet opening 43 and flange portion 62 in its normal operative position, as shown in the figures in solid line views. This will permit adjustment of the water inlet opening 43 to the appropriate angular position to conform to the V angle of the hull and specifically the surfaces 12 and 13.

As seen in the phantom line view of FIG. 6 when the jet propulsion units 29 are pivoted upwardly about their horizontal axes 48 and then rotated about the axis of the impeller shaft 36 by the motor 67, the water inlet openings 43 will be placed in registry with the access or service opening so that foreign material can be pulled out of the water inlet openings 43. Any suitable mechanism may be employed for raising and rotating the jet propulsion units in their aforenoted manner.

In the illustrated embodiment, only the water inlet portion of the jet propulsion units have been rotated relative to the discharge nozzles. Although this has certain advantages, in some instances it may be desireable to rotate the entire jet propulsion unit and various constructions have been illustrated in the prior art for accomplishing this operation.

It should be readily apparent from the foregoing description that the described construction is particularly effective in providing a jet propelled watercraft that has a V bottom and which is propelled by a pair of jet propulsion units Because of the orientation of the jet propulsion units, it is possible to insure that the jet propulsion units can be positioned in side by side relationship in a single relatively narrow tunnel and still be moved between their normal drive positions and their raised service positions and also that the steering thrusts generated by the steering nozzles will not cause any forces on the hull acting in a vertical direction or couples which might tend to cause the watercraft to list. Of course, the described embodiment is that of a preferred form in which the invention can be practiced and various changes and modifications may be made without departing from the spirit and scope of the invention, as defined by the appended claims.

We claim:

1. A jet propelled watercraft comprising a V bottom hull defined by a pair of downwardly converging lower side surfaces and having tunnel means disposed at the rear end thereof, a pair of jet propulsion units, each mounted in substantial part in said tunnel means in side by side relationship, said jet propulsion units each having a generally downwardly facing inlet opening through which water is drawn from the body of water in which said watercraft is operating and extending in a plane generally parallel to the respective lower side surface of said V bottom hull, and means for pivotally supporting each of said jet propulsion units for pivotal movement about a generally horizontally disposed transverse axis for raising said water inlet openings relative to the body of water in which said watercraft is operating.

2. A jet propelled watercraft as set forth in claim 1 wherein each of the jet propulsion units has an impeller shaft driven by an internal combustion engine for driving an impeller for moving water through the respective jet propulsion units, pivotal movement of said jet propulsion units about said horizontal axes effecting movement of said impeller shaft axes in parallel planes.

3. A jet propelled watercraft as set forth in claim 2 further including power means for pivoting the jet propulsion units about the horizontally disposed axis.

4. A jet propelled watercraft as set forth in claim 3 wherein the power means comprises hydraulic motors.

5. A jet propelled watercraft as set forth in claim further including means for rotating at least the water inlet portions of said jet propulsion units about axes disposed perpendicularly to the horizontal pivot axes.

6. A jet propelled watercraft as set forth in claim 5 wherein each of the jet propulsion units has an impeller shaft driven by an internal combustion engine for driving an impeller for moving water through the respective jet propulsion units, pivotal movement of said jet propulsion units about said horizontal axes effecting movement of said impeller shaft axes in parallel planes.

7. A jet propelled watercraft as set forth in claim 6 further including power means for pivoting the jet propulsion units about the horizontally disposed axis.

8. A jet propelled watercraft as set forth in claim 7 wherein the power means comprises hydraulic motors.

9. A jet propelled watercraft as set forth in claim 8 further including access means formed in the hull through which the water inlet openings may be services when the jet propulsion units are raised and the water inlet openings are rotated.

10. A jet propelled watercraft as set forth in claim 9 further including steering nozzles pivotally supported by the discharge end of the jet propulsion units for steering the watercraft.

11. A jet propelled watercraft as set forth in claim 10 wherein the steering nozzles are supported for pivotal movement about vertically extending pivot axes.

12. A jet propelled watercraft as set forth in claim 1 further including steering nozzles pivotally supported by the discharge end of the jet propulsion units for steering the watercraft.

13. A jet propelled watercraft as set forth in claim 12 wherein the steering nozzles are supported for pivotal movement about vertically extending pivot axes.

14. A jet propelled watercraft as set forth in claim 1 wherein the tunnel means comprises a single tunnel in which the jet propulsion units are both positioned in side by side fashion.

15. A jet propelled watercraft as set forth in claim 14 wherein each of the jet propulsion units has an impeller shaft driven by an internal combustion engine for driving an impeller for moving water through the respective jet propulsion units, pivotal movement of said jet propulsion units about said horizontal axes effecting movement of said impeller shaft axes in parallel planes.

16. A jet propelled watercraft as set forth in claim 15 further including power means for pivoting the jet propulsion units about the horizontally disposed axis.

17. A jet propelled watercraft as set forth in claim 16 wherein the power means comprises hydraulic motors.

18. A jet propelled watercraft as set forth in claim 14 further including means for rotating at least the water inlet portions of said jet propulsion units about axes disposed perpendicularly to the horizontal pivot axes.

19. A jet propelled watercraft as set forth in claim 18 wherein each of the jet propulsion units has an impeller shaft driven by an internal combustion engine for driving an impeller for moving water through the respective jet propulsion units, pivotal movement of said jet propulsion units about said horizontal axes effecting movement of said impeller shaft axes in parallel planes.

20. A jet propelled watercraft as set forth in claim 19 further including power means for pivoting the jet propulsion units about the horizontally disposed axis.

21. A jet propelled watercraft as set forth in claim 20 wherein the power means comprises hydraulic motors.

22. A jet propelled watercraft as set forth in claim 21 further including access means formed in the hull through which the water inlet openings may be services when the jet propulsion units are raised and the water inlet openings are rotated.

23. A jet propelled watercraft as set forth in claim 22 further including steering nozzles pivotally supported by the discharge end of the jet propulsion units for steering the watercraft.

24. A jet propelled watercraft as set forth in claim 23 wherein the steering nozzles are supported for pivotal movement about vertically extending pivot axes.

25. A jet propelled watercraft as set forth in claim 14 further including steering nozzles pivotally supported by the discharge end of the jet propulsion units for steering the watercraft.

26. A jet propelled watercraft as set forth in claim 25 wherein the steering nozzles are supported for pivotal movement about vertically extending pivot axes.

27. A jet propelled watercraft comprising a V bottom hull having tunnel means disposed at the rear end thereof, a pair of jet propulsion units, each mounted in substantial part in said tunnel means in side by side relationship, said jet propulsion units each having a generally downwardly facing inlet opening extending in a plane generally parallel to the respective side of said V bottom, a discharge nozzle portion formed at the end of each of said jet propulsion units through which water is discharged, and a pivotally supported steering nozzle pivotally supported at the end of said discharge nozzles and in registry therewith for discharging water rearwardly and for steering of said watercraft, said steering nozzles being supported for pivotal movement about a vertically extending pivot axis.

* * * * *

UNITED STATES PATENT AND TRADEMARK OFFICE

CERTIFICATE OF CORRECTION

PATENT NO. : 5,145,426

DATED : September 8, 1992

INVENTOR(S) : Kobayashi, et al

It is certified that error appears in the above-identified patent and that said Letters Patent is hereby corrected as shown below:

Column 6, line 43, Claim 5, after "claim" insert --1--.

Signed and Sealed this

Nineteenth Day of October, 1993

*Attest:*

*Attesting Officer*

BRUCE LEHMAN

*Commissioner of Patents and Trademarks*